United States Patent [19]

Highsmith

[11] Patent Number: 4,598,778

[45] Date of Patent: Jul. 8, 1986

[54] ROTARY ROCK BIT BALL PLUG

[75] Inventor: Albert E. Highsmith, Grand Prairie, Tex.

[73] Assignee: Dresser Industries, Inc., Dallas, Tex.

[21] Appl. No.: 733,177

[22] Filed: May 13, 1985

[51] Int. Cl.[4] ..... E21B 10/24

[52] U.S. Cl. ..... 175/371; 175/228

[58] Field of Search ..... 175/227, 228, 229, 369, 175/370, 371, 337, 339; 308/6 A

[56] References Cited

U.S. PATENT DOCUMENTS 3,990,525 11/1976 Penny ..... 175/337

4,179,003 12/1979 Cooper ..... 175/371

4,183,417 1/1980 Levefelt ..... 175/339

4,445,791 5/1984 Klima ..... 384/96

*Primary Examiner*—James A. Leppink

*Assistant Examiner*—Terry Melius

*Attorney, Agent, or Firm*—Fred A. Winans

[57] ABSTRACT

A rock bit having a cutter retained on an axle through an array of rolling members interposed within an interior annular space therebetween, and a passage defining a passage wall for inserting the rolling members from the exterior of the bit to the interior space. A plug for closing the passage, and retaining the members in the space is welded at an end adjacent the bit exterior and a contamination excluding snap ring is interposed between the plug and the passage wall for preventing weld slag or weld material from entering the passage.

6 Claims, 3 Drawing Figures

ROTARY ROCK BIT BALL PLUG

BACKGROUND OF THE INVENTION

1. Field of the Invention

The invention relates to a sealed bearing rotary rock bit and more particularly to a ball plug assembly therefor having a resilient ring element for eliminating weld material from entering the sealed lubricant volume during assembly of the bit.

2. Description of the Prior Art

It is well known, and a common practice, to retain the rotary cutter of a rotary rock bit on the journal axle thereof through an annular array of roller bearings or balls disposed between opposed, facing races of the journal and bearing cavity or internal bore of the cutter. Typically, during assembly, the conical cutter is placed over and mounted on the journal axle, and a number of properly sized steel balls are inserted into the space between the opposed annular races through a ball passage communicating with such annular space from the back of the bit leg. After the balls have been inserted to fill the annular space, the conical cutter is axially retained on the journal by the interference of the balls preventing axial displacement of the cutter. To complete the assembly of the cutter on each leg of the bit, the ball passage is itself blocked by an elongated plug member which is inserted into the ball passage, to prevent the balls from escaping.

The plug is generally a cylindrical rod, contoured at the interior end to form a portion of the journal raceway and sized at the opposite end to slidingly fit within the passage in a manner that permits relatively easy rotation of the plug so that, once inserted, the plug can be turned to place the contoured end in proper alignment in the ball raceway as indicated by an exteriorly observed contoured face on the opposite end. Intermediate the two ends, the rod defines a reduced diameter, or necked-down section, providing an annular space that permits the ball passage to subsequently function as a portion of the lubricant distributing system of the rotary rock bit.

To retain the ball plug itself, the enlarged exposed end is welded into the proper final position. It has been found that during the welding operation, contaminating weld material such as slag, can, on occasion, escape between the ball passage and the plug (remembering that the fit must be such that the plug is readily rotated within the passage) into the volume of the necked-down portion, and become entrained in the lubricant, as it is subsequently injected into the lubricant system and bearing cavity of the bit. Such contaminated lubricant, when distributed to the highly loaded bearings within the cutter and journal during operation, causes rapid degradation of the bearing surfaces which contributes to premature failure of the bearings.

SUMMARY OF THE PRESENT INVENTION

The present invention provides a split metal resilient ring, received within an annular groove in the plug adjacent the welded end and sized so that, upon circumferential compression, it will fit within the ball passage, but will resiliently expand to circumferentially seat on the sidewall of the passage. The ring acts like a snap ring, thereby engaging the wall of the passage to provide a seal, or at least a tortuous path, that, during welding of the plug end, prevents the weld slag and other contaminant material from entering into any gap between the plug and the passage wall, while at the same time, having a fit such that the plug can be relatively easily rotated for proper alignment subsequent to being inserted. The ring thereby maintains the lubricant system uncontaminated of weld material or slag.

DESCRIPTION OF THE PREFERRED EMBODIMENT

Figure 1:
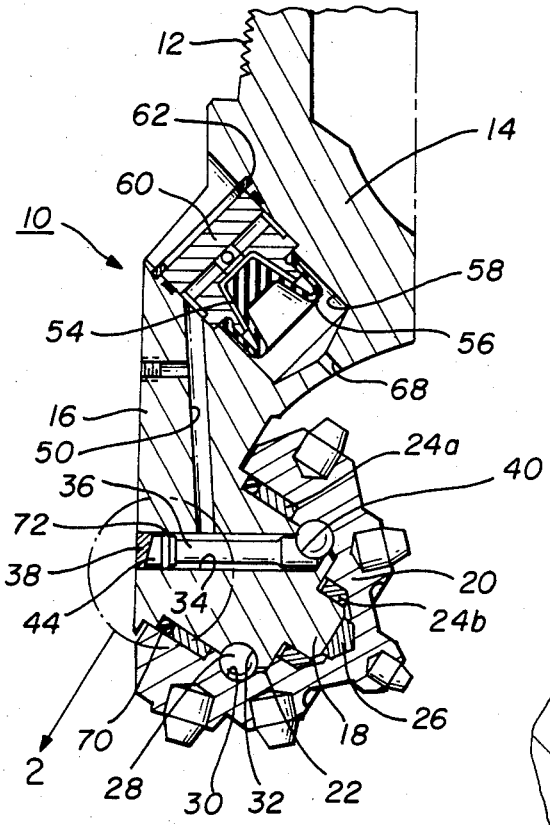
FIG. 1 is an elevational cross sectional view of a portion of one leg of a rotary rock bit in accordance with the invention.
Figure 2:
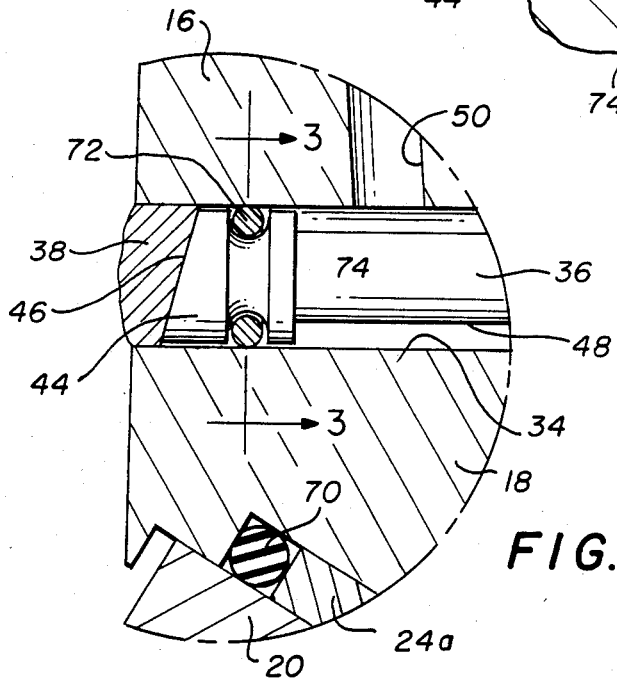
FIG. 2 is an enlarged view of a portion of FIG. 1 showing the ball plug end with the annular resilient ring in accordance with the present invention; and, FIG. 3 is a cross-sectional view of a portion of FIG. 2 generally along line 3—3 thereof.

Referring now to FIGS. 1 and 2, a sectional view of one section 10 of a rotary rock bit is shown to illustrate a typical sealed bearing rotary rock bit. As therein seen, the bit comprises an upper threaded portion 12 for threaded connection to the rotary drill string, an intermediate or dome portion 14 with at least one leg 16 depending therefrom terminating in an inwardly downwardly oriented axle portion 18. A rotary cutter assembly 20 is mounted on the axle portion 18 and defines an internal bearing cavity 22 which, in cooperation with the surface of the axle portion 18, provides radial and thrust load bearing assemblies. The bearing assemblies include an outer friction bearing 24*a*, an inner friction bearing 24*b* and a thrust button 26. Also included is an annular array of ball bearings 28 disposed between an annular raceway 30 formed in the bore of the cutter 20 and an opposed raceway 32 formed in the surface of the pin or axle portion 18. As is known in the art, the ball bearings 28 are inserted into the annular space between the opposed raceways 30,32 subsequent to the cutter assembly 20 being mounted on the journal pin 18 for retaining the cutter as thus assembled.

The balls 28 are inserted into the annular space defined by the raceways 30,32 through a ball passage 34 formed through the back face of the leg 16, and terminating adjacent the journal raceway 32. Once the space between the raceways is filled with an annular array of balls 28, a ball plug 36 is inserted in the passage 34 and welded therein as shown at 38.

Still referring to FIGS. 1 and 2, it is seen that the internal end of the ball plug 36 is contoured as at 40 so as to form a portion of the raceway 32 in the journal 18, and the opposite or welded end 44 has a slanted exterior face 46 that indicates to the person assemblying the bit when the plug 36 is in proper orientation. The welded end 44 is generally sized to snugly fit within the passage 34, but must not bind to prevent turning the plug 36 for such proper orientation. Upon being properly disposed, the plug 36 is subsequently welded. Further, as it is seen, intermediate the opposed ends 44,46 of the plug, the plug 36 defines a narrowed reduced diameter or necked-down section 48 so that the ball passage 34 comprises a portion of the lubrication distributing system.

The lubrication distributing system also includes a passage 50 that extends through the leg 16 to the ball passage 34 to allow lubricant to be transmitted to the previously defined bearing system. A lubricant reservoir 54 is located in the intermediate portion 14 of the bit to provide a supply of lubricant to the bearings through the passage 50 in the leg and ball passage 34. A flexible diaphragm 56 is positioned in a bore 58 and in cooperation with a cap 60, encloses the reservoir to retain a supply of lubricant. The upper end of the lubricant reservoir is closed by a cap 60 being locked in place by a snap ring 62. The diaphragm 56 is placed in communication with the ambient conditions through port 68 so that internal lubricant pressure is responsive to the ambient pressure to generally eliminate pressure differentials across the seal 70 provided in the mouth of the cone cavity 22 to seal the bearings from the ambient atmosphere; thereby, providing a sealed bearing cavity and lubrication distributing system.

Subsequent to the cutter assembly 20 being assembled on the axle 18, the lubricant distributing system is filled with a suitable lubricant, thus causing the lubricant to fill the reservoir 54 and flow through the various passages 34,50. It is noted that upon the lubricant being inserted through the passages, particularly passage 34, any material from the welding of the ball plug 36, which has entered the passage 34 between the welded end 44 and the passage walls, will be entrained in the lubricant such that it will be distributed throughout the bearing system. These particles of slag or weld material are subsequently distributed with the lubricant to the highly loaded bearings, causing degradation of the bearing surfaces.

Figure 3:
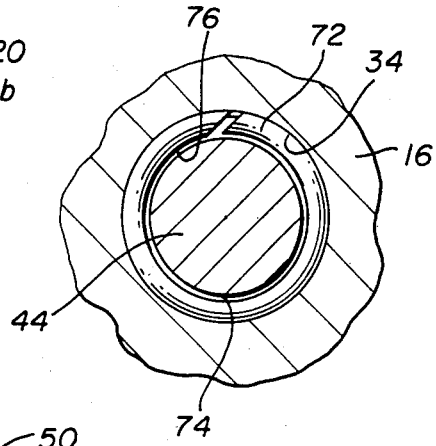

In accordance with the present invention and with further reference to FIG. 3, an annular resilient split metal ring 72 is disposed within an annular groove 74 formed in the welded end 44 of the plug 36. The ring 72 in its compressed form, is seated within the groove 74 and defines an outer diameter that permits ready insertion of the plug in the passage 34. Once inserted, the inherent resiliency causes the ring 72 to expand and forcefully engage the wall of the passage 34 on its O.D. while being in close proximity to a surface (i.e. an axial face) of the groove 74 on the plug to provide, if not a seal, at least a sufficiently tortuous path that prevents slag or weld material from entering the passage 34 during welding of end 44. It is shown that, upon expansion of the split ring 72 to the diameter of passage 34, a small gap may exist between opposed ends of the rings; however, such gap is not sufficiently large to permit slag material to enter therethrough. Other configurations can be provided wherein such gap could also be a tortuous path or otherwise minimized.

Referring specifically to FIG. 3, the split ring 72 is shown in seated position within the passage 34, and as therein seen, there exists a radial gap 76 (which in this instance is exaggerated for purposes of illustration) between the base of the annular groove 74 in the pin and the I.D. of the expanded ring 72 to emphasize that, in such assembled position, there is not an interference fit that would prevent the ball plug 36 from being subsequently oriented to the proper position permitting the opposite end 40 to assume a continuous surface with the ball race in the pin.

Thus, a ring 72 for excluding the welding contaminants is provided that does not interfere with the assembly of the parts; and, provides a limited frictional engagement between the ball plug 36 and the passage 34 such that, in addition to preventing the welding contamination from entering the passage, will tend to hold the plug 36 in the final orientation, so that it does not move, during the subsequent welding, to an orientation that might prevent the roller balls 28 from rolling along the inner raceway 32.

I claim:

1. In a rotary rock bit having a cutter rotatably mounted on a journal axle of a bit leg and means disposed in a space defined by annular facing grooves of said axle and cutter for axially retaining said cutter on said axle, a passage extending through said leg from an exterior surface of said leg to said space forming a portion of an internal fluid distributing system for directing fluid to between said cutter and axle, a plug member received within said passage to close said passage adjacent said exterior surface, said plug member welded to said leg adjacent said exterior surface, and means adjacent said welded end of said plug for preventing slag or weld material from entering said passage interiorly thereof and being entrained in said fluid therein, said preventing means comprising a resilient metal ring circumferentially deformable from a first circumference to a second circumference, and received within an annular space defined between said passage wall and said plug member for generally spring biased resilient circumferential engagement with an annular radially facing surface of either said plug member on said passage wall, and radially spaced from the opposed radial surface of the other of said plug member or said passage wall.

2. Structure according to claim 1 wherein said plug member has an annular groove adjacent the weld end and said ring has a first circumference larger than said passage wall circumference, but compressible to a second circumference within said groove to at least the circumference of said passage wall, whereby said plug with said compressed ring can be inserted into said passage, and said ring expands to circumferentially engage the passage wall and is closely adjacent an axial portion of said groove in said plug member.

3. Structure according to claim 2 wherein said ball plug has an interior end that, in proper orientation, forms a portion of said opposed annular groove for proper receipt of said retaining means therebetween, and means on said welded end of said plug for indicating the orientation of said interior end, and wherein the engagement between said ring, said plug and said passage wall, provides sufficient frictional engagement to permit relatively easy manipulation of said plug to said proper orientation and retain it in said position during the subsequent welding of said plug member.

4. A rock bit having a cutter retained on an axle through an array of rolling members interposed within an interior annular space therebetween and a passage, defining a passage wall for inserting said rolling members from the exterior of said bit to said interior space, a plug for closing said passage and retaining said members in said space, said plug welded adjacent the bit exterior for securing the plug, and a resilient metal ring means interposed between the plug and the passage wall for resiliently engaging said wall and preventing weld slag or weld material from entering said passage interiorly of said preventing means.

5. Structure according to claim 4 wherein said plug member defines an annular groove, and said preventing means is disposed within said annular groove and having a resilient bias to generally sealingly engage a radial facing surface on the passage wall closely adjacent an axially facing surface of said groove.

6. Structure according to claim 5 wherein said groove in said plug member is closely adjacent the welded end.

* * * * *